US011511153B2

(12) United States Patent
Kramer

(10) Patent No.: US 11,511,153 B2
(45) Date of Patent: Nov. 29, 2022

(54) APPARATUS REDUCING COMPENSATORY LEG, ANKLE AND FOOT MOVEMENTS DURING HEEL RAISE EXERCISES IN REHABILITATION AND FITNESS

(71) Applicant: Willem Kramer, Fort Worth, TX (US)

(72) Inventor: Willem Kramer, Fort Worth, TX (US)

( * ) Notice: Subject to any disclaimer, the term of this patent is extended or adjusted under 35 U.S.C. 154(b) by 0 days.

(21) Appl. No.: 17/190,736

(22) Filed: Mar. 3, 2021

(65) Prior Publication Data

US 2021/0275870 A1 Sep. 9, 2021

Related U.S. Application Data

(60) Provisional application No. 62/984,329, filed on Mar. 3, 2020.

(51) Int. Cl.

| | |
|---|---|
| ***A63B 23/08*** | (2006.01) |
| ***A63B 23/10*** | (2006.01) |
| ***A63B 21/00*** | (2006.01) |

(52) U.S. Cl.

CPC ..... *A63B 23/085* (2013.01); *A63B 21/00047* (2013.01); *A63B 23/10* (2013.01); *A63B 2208/0204* (2013.01); *A63B 2209/14* (2013.01); *A63B 2225/09* (2013.01)

(58) Field of Classification Search

CPC ... A63B 23/085; A63B 23/10; A63B 23/0004; A63B 23/068; A63B 21/00047; A63B 21/0458; A63B 21/08–10; A63B 2208/0204; A63B 2209/14; A63B 2225/09; A63B 21/0004; A63B 21/068; A61H 1/0237; A61H 1/0266

See application file for complete search history.

(56) References Cited

U.S. PATENT DOCUMENTS

| | | | | |
|---|---|---|---|---|
| 5,354,247 A * | 10/1994 | Wilkinson | ..... | A63B 23/0458 206/505 |
| 5,474,509 A * | 12/1995 | Hodgdon | ..... | A63B 23/0458 482/52 |
| 10,406,395 B2 * | 9/2019 | Haas | ..... | A63B 23/08 |
| 2009/0111669 A1 * | 4/2009 | Richter | ..... | A63B 21/4039 482/142 |

(Continued)

FOREIGN PATENT DOCUMENTS

| | | |
|---|---|---|
| DE | 20201001027701 | 12/2010 |
| JP | 2019076368 | 5/2019 |

OTHER PUBLICATIONS

Livestrong.com, "How to Use a Block Step for a Calf Raise", Jun. 15, 2016, YouTube, https://www.youtube.com/watch?v=FRbHEHovw_Q (Year: 2016).*

(Continued)

*Primary Examiner* — Erin Deery
*Assistant Examiner* — Peter H Forstner
(74) *Attorney, Agent, or Firm* — McNees Wallace & Nurick

(57) ABSTRACT

Portable blocks of high density, closed cell foam each with a different height, in progression from shortest to tallest. The taller blocks have tops divided in half width-wise, creating an upper and lower surface. As such, a user engages the blocks with a foot of the user straddling the upper half and the lower half; wherein upon a heel raise of the user upon the block, plantar and dorsiflexion movement is achieved substantially devoid of pronation and supination.

14 Claims, 14 Drawing Sheets

Dorsiflexion 5

Plantar flexion 4

(56) References Cited

U.S. PATENT DOCUMENTS

| | | | | |
|---|---|---|---|---|
| 2014/0066262 | A1* | 3/2014 | Kennedy | A63B 71/0036 482/52 |
| 2015/0297128 | A1* | 10/2015 | Shield | A63B 21/0442 600/595 |
| 2016/0199690 | A1* | 7/2016 | Islas | A63B 21/00047 482/79 |
| 2019/0374813 | A1* | 12/2019 | Sotter | A63B 23/08 |

OTHER PUBLICATIONS

Marc Surdyka, Tibialis Posterior Tendinopathy, May 30, 2021, E3 Rehab, p. 12. https://e3rehab.com/blog/tibialisposterior/ (Year: 2021).*

* cited by examiner

APPARATUS REDUCING COMPENSATORY LEG, ANKLE AND FOOT MOVEMENTS DURING HEEL RAISE EXERCISES IN REHABILITATION AND FITNESS

CROSS-REFERENCE TO RELATED APPLICATIONS

The present application claims benefit of provisional application Ser. No. 62/984,329, filed Mar. 3, 2020, the entire contents of which are herein incorporated by reference.

BACKGROUND

Field of Invention

The invention relates to the field of fitness and physical therapy and athletic training. Particularly, comprehended is an apparatus that elicits proper form and execution of resisted, single leg, bent or straight knee, heel raise exercises by reducing rotation of the leg and reducing over pronation and supination of the foot/ankle complex, i.e. compensatory movements.

Description of the Related Art

A calf or heel raise exercise (with bent or straight knee) is often used by therapists, coaches and trainers to treat and prevent injury and improve foot alignment. These exercises further result in improved joint stability of the lower extremity and overall posture and well-being. The exercise is considered to consist mostly of two movements, dorsiflexion and plantar flexion (FIG. 1). Dorsiflexion or ankle flexion is pulling the top of the foot toward the (lower) leg. While plantar flexion or ankle extension is the opposite, i.e. pointing the top of the foot away from the (lower) leg. Both are everyday ankle movements and occur, for example, during walking and running.

A healthy gait or a properly executed calf raise exercise, results in dorsiflexion combined with a slight inward rotation of the (lower) leg and some degrees of eversion/abduction of the foot/ankle complex. While plantar flexion is combined with a slight outward rotation of the (lower) leg and inversion/adduction of the foot/ankle complex. These combination movements are barely visible and above all are natural or functional and, to a certain degree, necessary. However, the movements can be excessive.

The design of the human body combined with our chronic lack of physical activity and the absence of a true physical education (learning how to use your body the right way) during our developmental years promote compensatory movements instead of just the natural combination movements. Gait, a calf raise exercise and even just standing results, for most humans, in a (strongly) pronounced inward/outward rotation of the leg and a more than necessary eversion/inversion and abduction/adduction of the ankle/foot complex (FIG. 2, 3). Only very fit and well taught/trained individuals with great motor control and strength can use particular hip, leg and foot muscles correctly, thereby reducing both rotation of the leg and eversion/inversion and abduction/adduction of the foot/ankle to a functional minimum.

Difficult as it may be, a heel raise without compensatory movements is necessary for preventing and treating pain and injuries, promoting a healthy foot alignment and posture (FIG. 4) and general well-being (i.e. ambulation). A correctly executed heel raise utilizes the medial arch of the foot (FIG. 5) and activates muscles involved in maintaining alignment, securing joint stability and proper function of the ankle and foot. Despite the previous, fitness trainers, (strength) coaches, therapists and other professionals often allow a calf raise with potentially harmful compensatory movements. There is currently no easy way to correct them. For those fitness trainers, strength coaches and therapists who do try to avoid compensatory movement, a double legged heel raise exercise with the toes pointed outward, and then telling their patients/clients to "push through the inside of their foot/feet", is the only viable option. A heel raise done with the toes pointed outward slightly reduces the unwanted compensatory movements and is the closest to a proper calf raise ("true" dorsiflexion and plantar flexion) currently attainable.

Although executing a calf raise with the toes pointed outward is currently the best alternative, it has several drawbacks. For one, the rotational and eversion/abduction and inversion/adduction movements are still not reduced to their functional range. In addition, it makes a single leg variation difficult to execute and places the joints of the lower extremity in an unnatural, outward rotated, position. Walking, jogging and running require single leg dorsi/plantar flexion and a neutral or longitudinally stacked position of foot, ankle, knee and hip joints.

The instant apparatus makes a calf raise with almost no compensatory movement effortlessly possible, allows a single leg variation of the exercise, keeps the joints of the lower extremity lined up longitudinally (FIG. 6) and can be used by a novice lacking both strength and (motor) control. In addition, and unlike its currently available alternatives (i.e. dumbbells and gym equipment), it is very easy to use, portable and affordable.

SUMMARY

Comprehended are portable blocks of high density, closed cell foam with each a different height, respectively twelve (12) millimeters (mm), twenty-two (22) mm, thirty-two (32) mm and forty-two (42) mm. The 22, 32 and 42 mm blocks have a top divided in half width-wise, creating an upper and lower surface. The lower surface is 12 mm lower (preferably) than the upper surface. The 12 mm high block does not have an upper/lower top surface.

In a method for reducing compensatory leg complex movements, the steps comprise: providing multiple blocks, wherein each block varies in size, and wherein at least one of the blocks includes a top divided in two-halves thereby forming an upper half and a lower half at the top; wherein the upper half and the lower half differ in height so as to allow a user to engage the block with a foot of the user straddling the upper half and the lower half; wherein upon a heel raise of the user upon the block, plantar and dorsiflexion movement is achieved substantially devoid of pronation and supination. The lower half of each the block is twelve (12) millimeters lower than the upper half, and each block consists of high density, closed cell foam. Accordingly, the user engages each block in progression from shortest to tallest, thereby increasing dorsiflexion of the user. For the step of straddling, first and second toes of the user engage the upper half and third, fourth and fifth toes of the user hang over the lower half, thereby an edge of the upper half is disposed along a longitudinal axis of the foot such that the heel raise is multi-axial.

More particularly, the twelve (12) mm rise or height difference, makes it possible to, during heel raise exercises (ankle extension/flexion), keep compensatory movements (i.e. rotation, adduction/abduction, eversion/inversion) within an acceptable or functional range, without any added effort. Using the apparatus makes a calf raise exercise automatically amount to, largely, a plantar- and dorsiflexion movement. Regardless of foot size and width, a critical rise of 12 mm warrants the desired results. Below 12 mm subjects can exhibit an increased use of the lateral and/or metatarsal arch of the foot, resulting in (more) pronounced and unwanted compensatory movements of the leg and foot/ankle complex. A rise higher than 12 mm does not reduce the compensatory movements further.

DETAILED DESCRIPTION OF THE PREFERRED EMBODIMENT

Referencing now FIGS. 1-31, shown and described is the instant method and apparatus for use by a (human) user's leg complex 1, meaning herein a human's lower leg, ankle and foot anatomy, to reduce compensatory leg complex movements. "Compensatory" movements mean excessive inward or outward rotation of the leg and excessive eversion/abduction of the foot/ankle complex. The method and apparatus activates muscles important for, and involved in, proper foot/ankle alignment, function and joint stability of the lower extremity. In fact, a typical heel raise activates about eight leg complex muscles, wherein a heel raise using the instant methodology activates approximately sixteen muscles.

Figure 7:
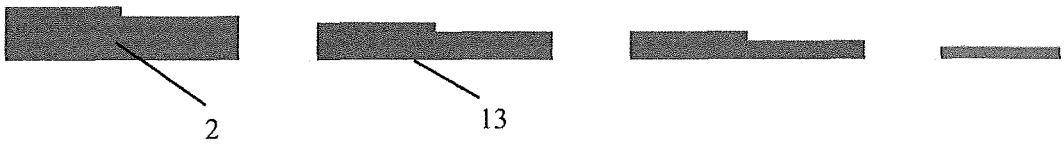
FIG. 7 is a side view in elevation showing four different example heights of the apparatus. For example, shown is a twelve (12) mm high rectangle, a twenty-two (22 mm), thirty-two (32) mm and forty-two (42) mm high, isosceles trapezoid block.
Figure 8:
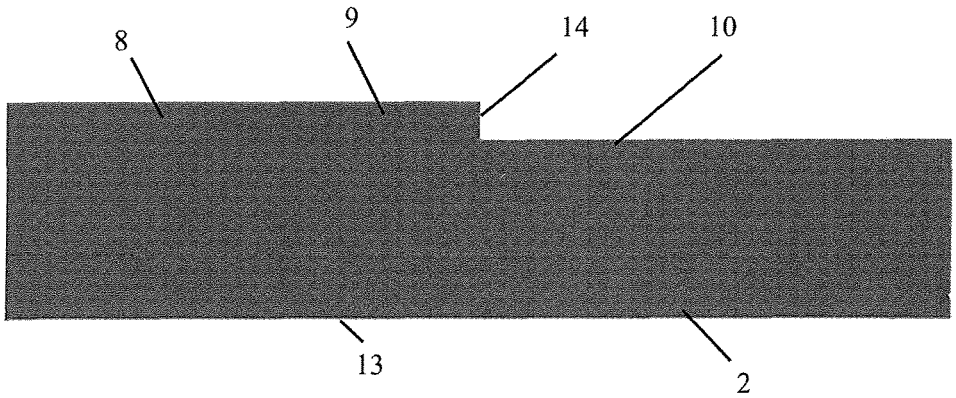
FIG. 8 shows the 32 mm-high, isosceles trapezoid with its 20 mm high lower surface.
Figure 9:
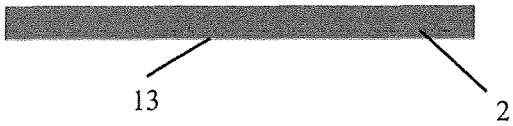
FIG. 9 shows the 12 mm high rectangle shaped apparatus.

Accordingly, comprehended are multiple (shown herein as four), portable (light weight), blocks 2. "Block(s)" means a generally cubical block adapted to be placed on a floor surface, although the block 2 can take any shape as long as it has a flat surface and the aforementioned variable, top surface. In one embodiment herein the block 2 is rectangular in cross-section, and in another embodiment the block 2 is trapezoidal, having a wider base for instance. The block 2 is preferably made of EPP (expanded polypropylene, 60 g/l EPP), closed cell, high density foam with high tensile strength. In one embodiment, the top 8 (upper surface) of the trapezoids measures 70 mm wide and 130 mm long. The bottom 13 is slightly larger and measures 70 mm wide by 134.2 mm long. The foot-print for the tallest trapezoid is 140 mm×150 mm, the middle 140 mm×144.52 mm and the shortest 140 mm×139 mm. Preferably, in another embodiment, one block 2 is generally rectangular and measures 70 mm wide by 130 mm long by 12 mm high (FIG. 9, 26). This smallest block 2 has an entirely flat top 8. The other three (3) blocks 2 are three-dimensional, isosceles trapezoids (a quadrilateral with one pair of opposite sides parallel, sometimes referred to as trapezium) with each a different, progressing height (FIG. 7). For these tallest three blocks 2, the top 8 of each is divided in half, width-wise, with one upper half 9 being twelve (12) mm taller/higher than the other lower half 10 (FIG. 8, 27, 28). For the highest block 2, the height measures 42 mm for the upper surface and 30 mm for the lower surface. For the middle highest block 2, the upper surface measures 32 mm and lower surface 20 mm. And for the lowest of the three "tall" blocks 2, the upper surface is 22 mm and lower surface 10 mm high. These overall height variations of the blocks 2, whether trapezoidal or cubical, herein defined as "progression", is critical to the invention, as is the difference in height between the upper half 9 and each lower half 10. Regardless of foot size, a progressive rise of 10 mm between the blocks warrants the desired results. Below 10 mm, subject users can exhibit an increase of compensatory movements during heel raises. A rise higher than 10 mm does not reduce compensatory movements any further. In addition, a twelve (12) mm difference between halves 9, 10 is further ideal anatomically.

Height differences (a rise) of and over 10 mm are still effective in reducing compensatory movements. They do, however, increase the chance of injury and pain due to a more extreme positioning of the joints of the foot/ankle complex. That said, instead of a single number representing the height difference between the upper half 9 and lower half 10, we propose a rise-range of 1 mm to 50 mm.

In one embodiment, at the bottom 13 of each block, two channels 11 (optional) may be defined. The optional channels 11 are preferably 5 mm deep, 45 mm long and run the full 140 mm width of the trapezoid (FIG. 16, 17) for example. In the tallest block the channels 11 are situated 15 mm from the long edges (width-wise) of the trapezoid. For the middle trapezoid it is 12.35 mm and for the shortest one 9.72 mm from the long edges of the trapezoid. The optional channels 11 may used to secure elastic bands 12, adding longitudinally aimed resistance to the heel raise exercises (FIG. 19).

The four different, progressing heights of the blocks 2 allow for a gradual increase of difficulty and limit the possible (re-)occurrence of unwanted compensatory movements. A novice user starts by using the 12 mm block. It allows a free plantar flexion 4 range while limiting the dorsiflexion 5 range to three (3) degrees only—for a subject with a male shoe size 8.5. From here the user works his/her way up to the 22 mm high apparatus, before using the 32 mm and finally the 42 mm high apparatus. Taller blocks 2, more degrees of dorsiflexion 5, can result in a more pronounced compensation. A gradual increase of height reduces the chances of compensatory movements (inward rotation of the leg and eversion/abduction of the foot/ankle complex) during the dorsiflexion part of the calf raise exercise. Standing up straight and touching the floor with the heel, the 4 different heights of the blocks force (for a male with a 8.5 shoe size) about 3, 7, 11, and 15 degrees of dorsiflexion. In comparison, normal/healthy gait requires a maximum of 8-10 degrees dorsiflexion on average. Running requires more range of motion. The use of a standardized protocol provided with the apparatus is advised.

Figure 18:
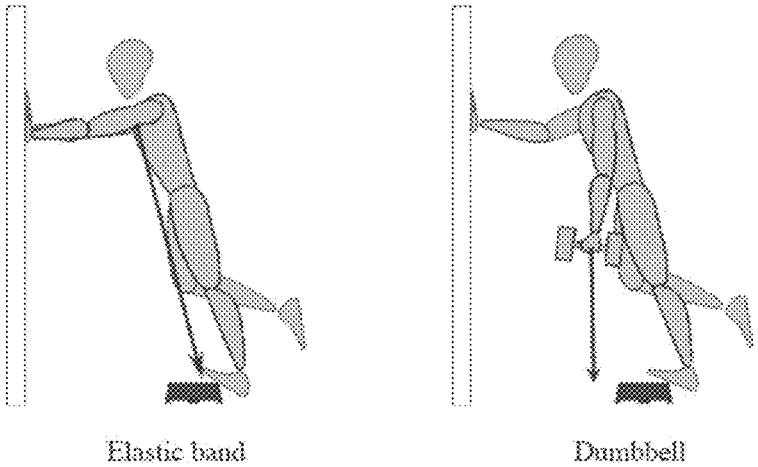
FIG. 18 is an illustration showing the vector when using an elastic band versus a dumbbell with the apparatus. The elastic band exerts a more longitudinal force. The dumbbell exerts a vertical one. The dumbbell vector moves further away from the body the more the user leans forward. During gait and more so during running, humans naturally lean forward.
Figure 19:
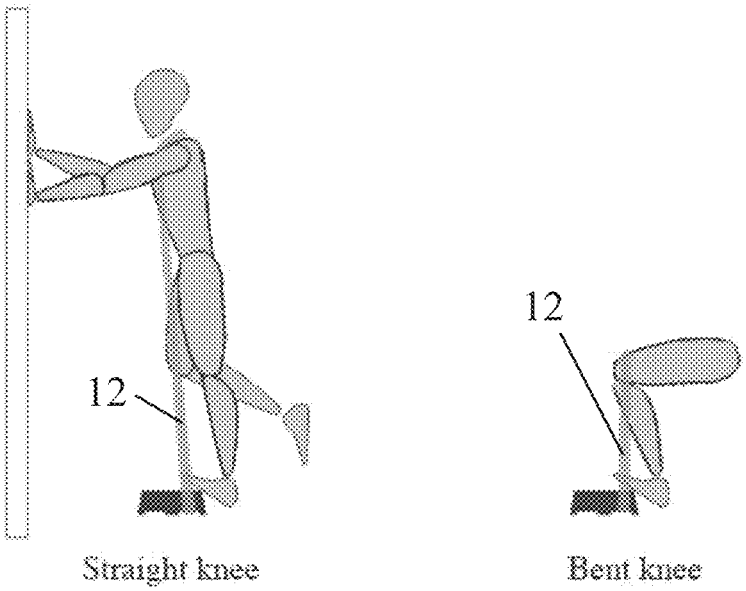
FIG. 19 shows the use of an elastic band during a straight knee and bent knee calf raise exercise.

The use of an elastic band 12, secured in the channel 11 under the ball of the big toe, allows for a longitudinal resistance (FIG. 19). Both during the straight knee (standing) and bent knee (sitting) variation of the single leg, calf raise exercise. For a calf raise, longitudinally aimed resistance is more difficult to accomplish with dumbbells, barbells or equipment. This is especially true when the calf raise is done while leaning forward slightly (FIG. 18). Leaning forward (slightly) when executing a calf raise is a more functional way of doing the exercise. During gait, and more so during running, humans lean forward.

The bands 12 used can come in variable lengths, for instance two different lengths. A long band (104 cm or 41 inches) for the standing calf raise exercise and a shorter (30 cm or 12 inches) one for the sitting exercise. Bands 12 come in different levels of resistance, level 1 to 6, with 1 being the lightest and 6 the heaviest. All bands 12 are preferably 4.5 to 5 mm thick and have different widths depending on their resistance—they do not exceed 45 mm width. Again, the previously described elastic bands 12 are used to add resistance. The user places an elastic band 12 through the channel directly under the ball of the first two toes. The long band is used for the straight exercise, a shorter one for the bent knee one. For the straight knee exercise the elastic band 12 runs over the front of the body (the chest) and is placed over the head, in the neck of the user. With the foot 3 on the apparatus and the back straight the user erects (stands up straight), pulling the elastic band 12 taut (FIG. 19). From here the user executes the exercise. For the bent knee or sitting variation of the calf raise exercise a shorter elastic band 12 is used. Standing on the block 2 the user pulls the elastic band 12 to just over the knee and sits down while holding the band 12 in place. With the elastic band 12 on the very distal end of the thigh (FIG. 19) the user starts the exercise. Once seated the ankle movement is exactly the same as when performing a straight knee (standing) heel raise.

Figure 20:
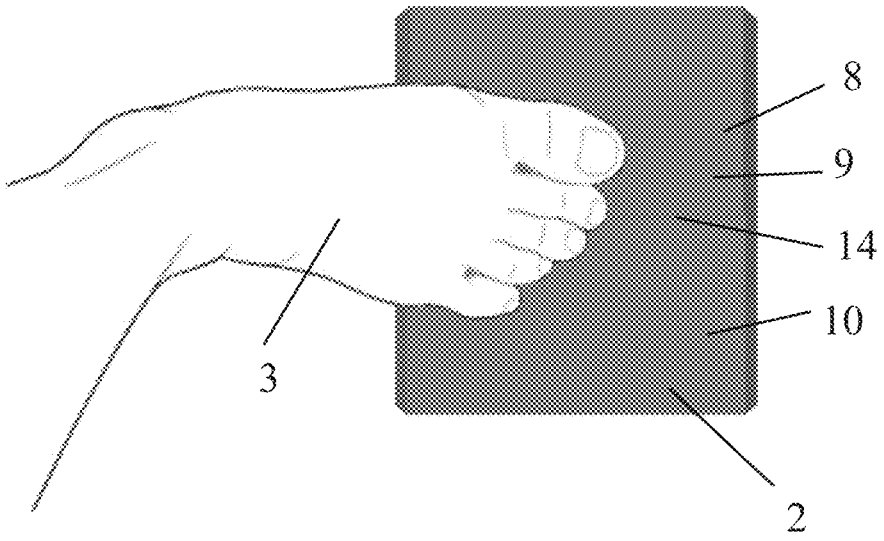
FIG. 20 shows a top view of the placement of the foot on the block apparatus. The balls of the 1st and 2nd toe are placed on the upper surface, the lesser 3rd, 4th and 5th toes are "supported" by the lower surface, i.e. hang over. The inner edge of the upper trapezoid surface is positioned in-line with the longitudinal axis of the foot.
Figure 21:
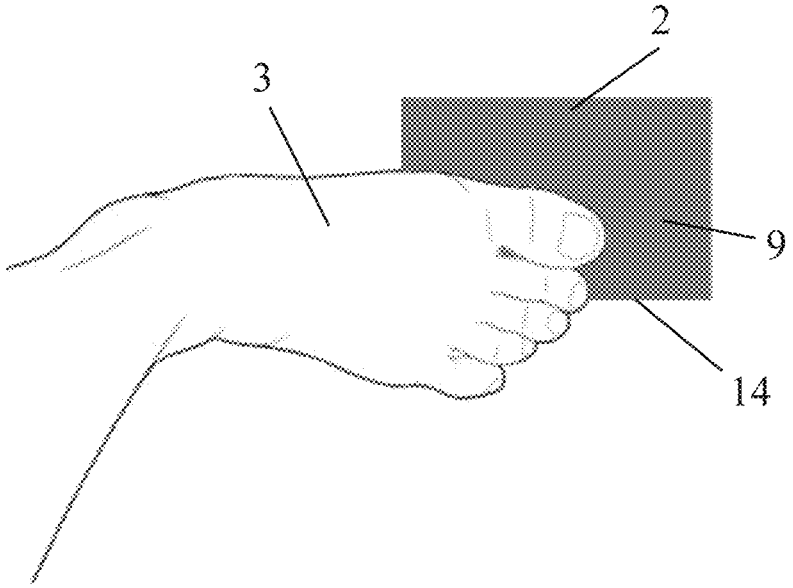
FIG. 21 shows a top view of the placement of the foot on the rectangular shaped apparatus. The balls of the 1st and 2nd toe are placed on the rectangle, the lesser 3rd, 4th and 5th toes are "supported" by the floor. The long edge of the apparatus is positioned in-line with the longitudinal axis of the foot.
Figure 22:
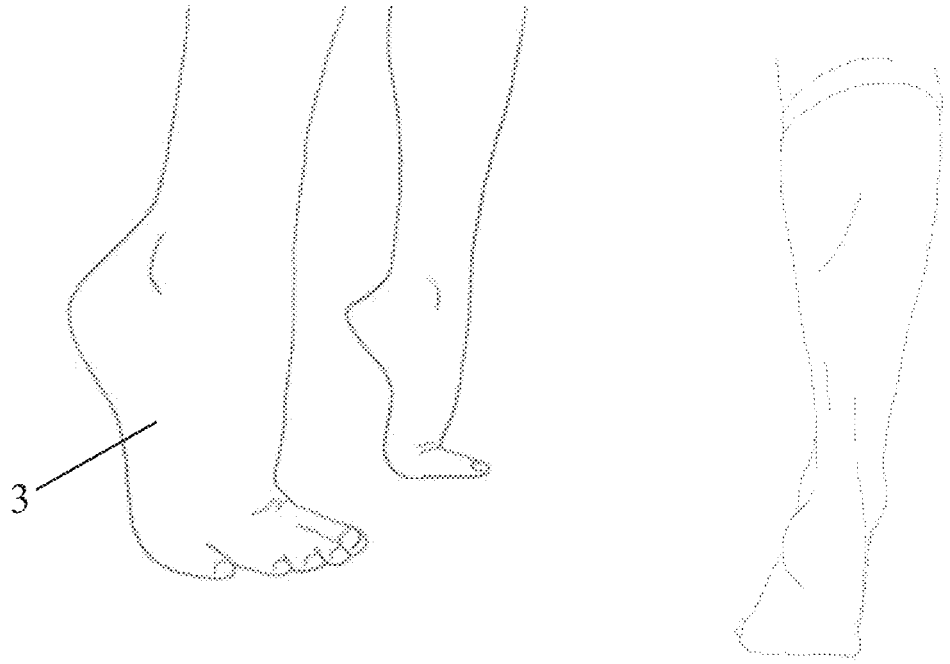
FIG. 22 shows a heel raise with too much compensatory movements. Outward rotation leg and adduction/inversion of the foot/ankle complex is clearly visible during this upward (plantar flexion) part of the exercise.
Figure 23:
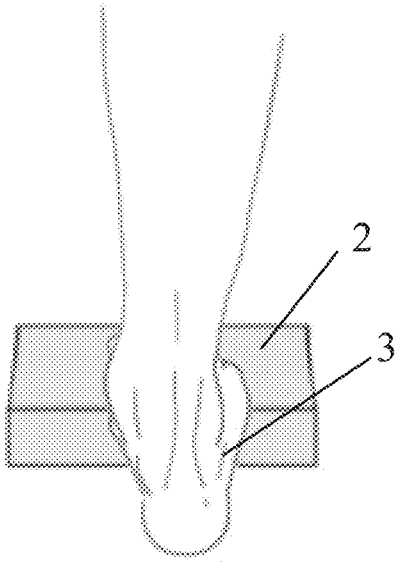
FIG. 23 shows a calf raise with too much compensatory movements. Inward rotation leg and abduction/eversion of the foot/ankle complex is clearly visible during this downward (dorsiflexion) part of the exercise.
Figure 24:
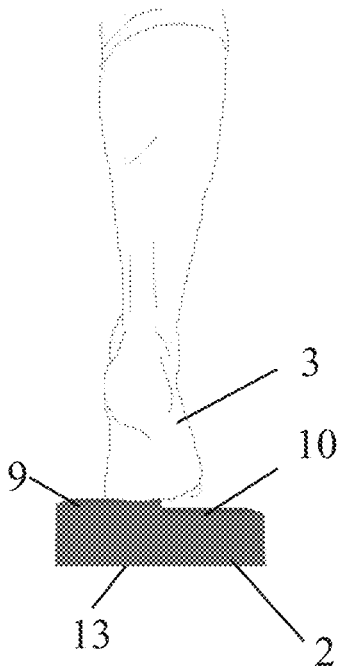
FIG. 24 shows a correctly executed calf raise exercise about the instant block. The upward (plantar flexion) part of the exercise is clear mostly of (excessive) compensatory movements.
Figure 25:
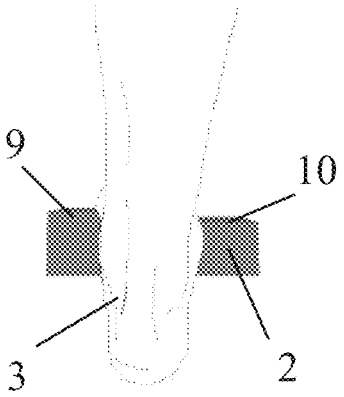
FIG. 25 shows a correctly executed calf raise exercise. The downward (dorsiflexion) part of the exercise is clear mostly of (excessive) compensatory movements.
Figure 26:
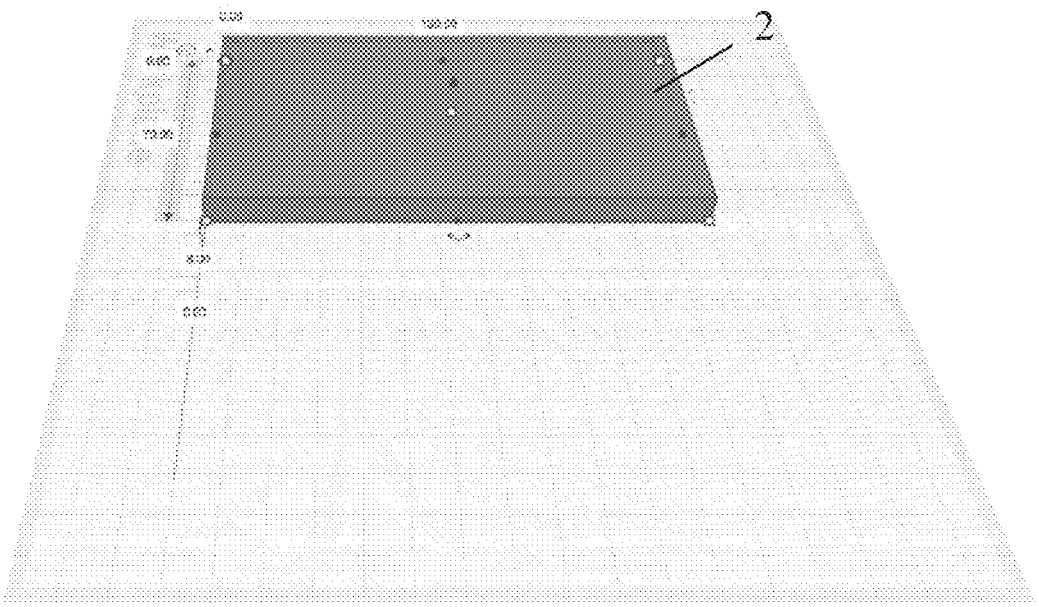
FIG. 26 shows a 3D image of an embodiment of the block consisting of a 130 mm by 70 mm by 8 mm rectangle.
Figure 27:
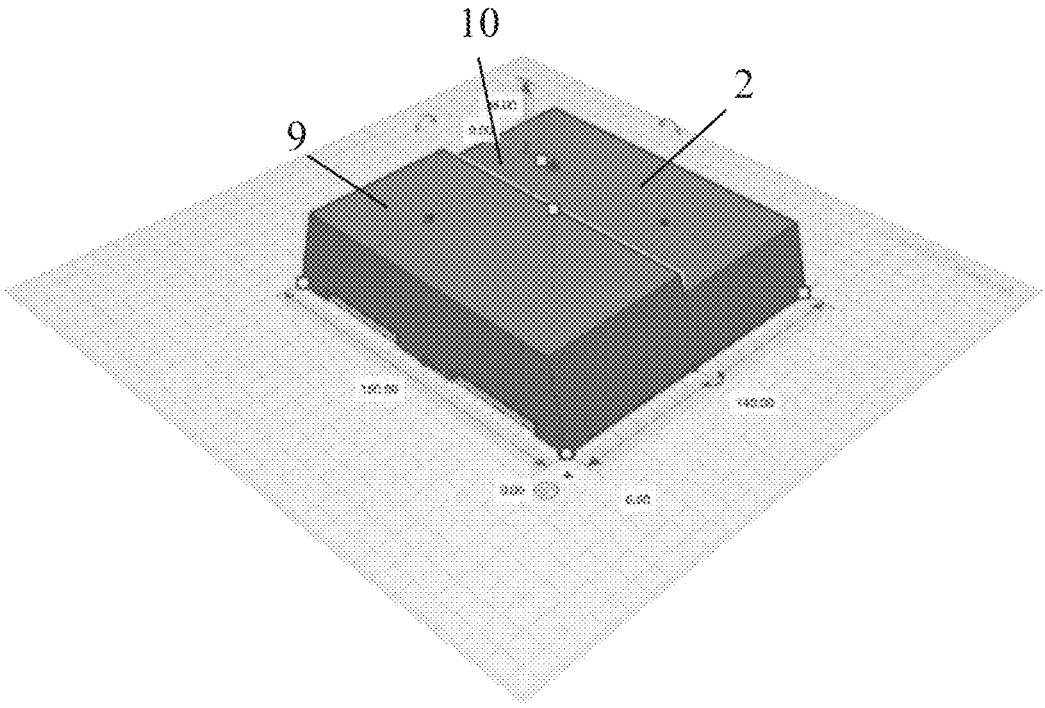
FIG. 27 shows a 3D image of the tall, isosceles trapezoid. As an example only, it has a foot print of 140 mm by 150 mm. The upper and lower surface are clearly visible. The upper surface measures 130 mm by 70 mm. The lower surface measures 134.2 mm×70 mm. The two channels for use of elastic bands are clearly visible.
Figure 28:
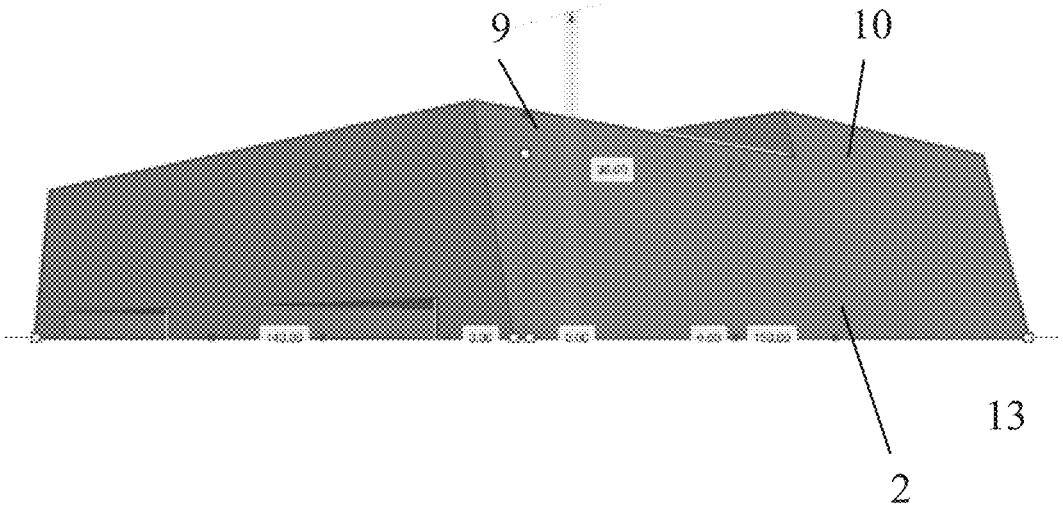
FIG. 28 shows a 3D image of the same block, isosceles trapezoid shown in FIG. 27. The only difference is the perspective view of the image.
Figure 29:
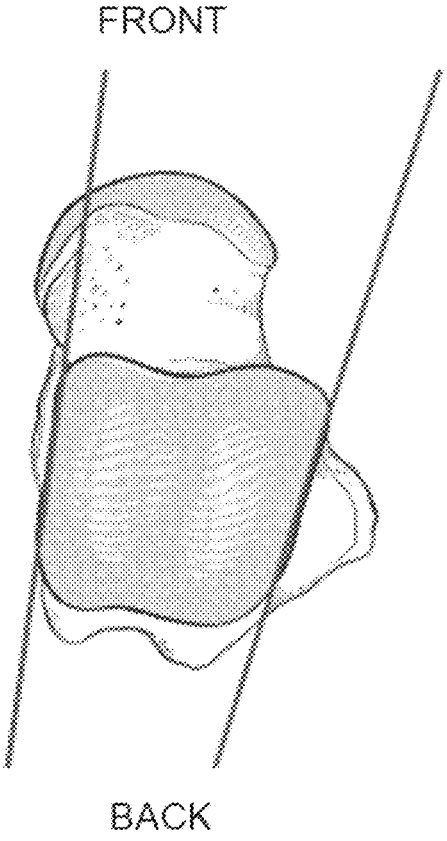
FIG. 29 shows the wedge shape of the upper articular surface of the talus.
Figure 30:
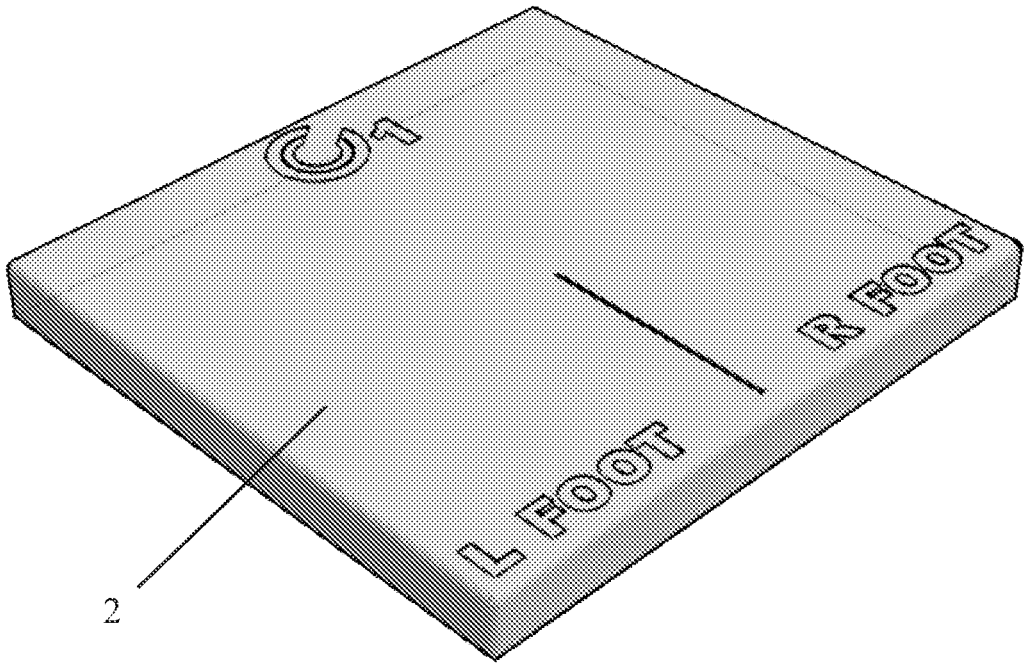
FIG. 30 shows a perspective view of an alternative embodiment of the small block, enlarged.
Figure 31:
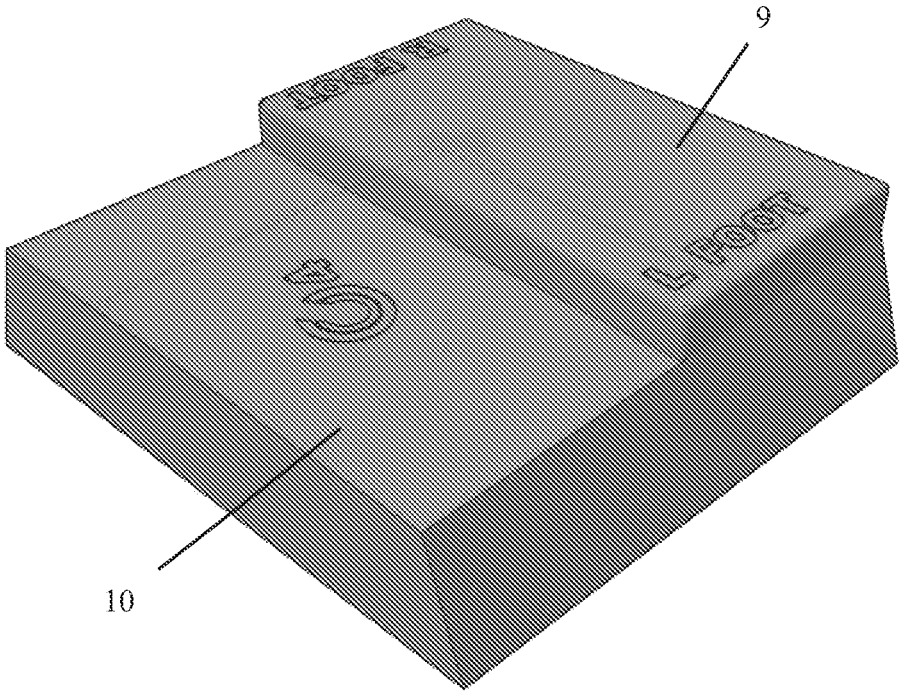
FIG. 31, shows a perspective view of an alternative embodiment of a tall block, enlarged.

In typical use, preferably shoe-less (or with socks), the user places the "ball" or "head" of ONLY the 1st and 2nd toes (only the 1st toe can be used if necessary) of the foot 3 on the block 2, i.e. rectangular shaped apparatus or on the upper half 9 of the trapezoid (FIG. 20, 21). The three (3) lesser toes are free from the rectangle/upper surface and "supported" by the floor (when using the rectangular shaped apparatus) or lower half 10 of the block 2. The foot 3 is placed in such a way that the inner edge 14 of the upper half 9, or the long edge of rectangular shaped apparatus, is in-line with the longitudinal axis of the foot 3. From here the subject executes either a straight knee or bent knee, single leg calf raise exercise, either with or without added resistance (ie dumbbell, elastic band).

Figure 10:
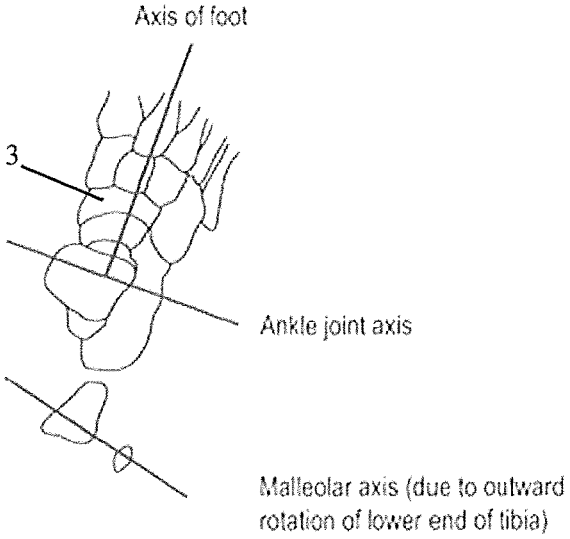
FIG. 10 is an illustration showing the axes of the malleoli (lower end of tibia and fibula), the ankle joint and the foot.
Figure 11:
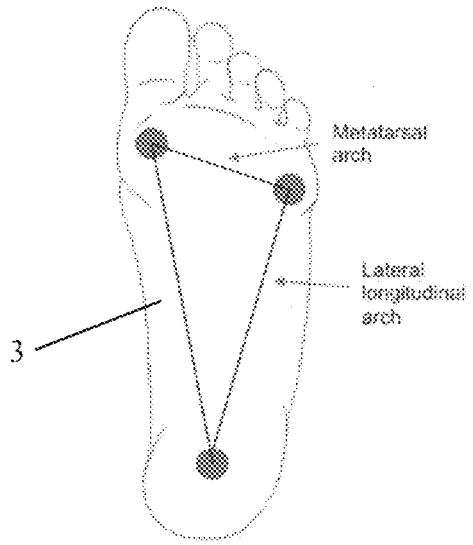
FIG. 11 shows the lateral and metatarsal arches of the foot.
Figure 12:
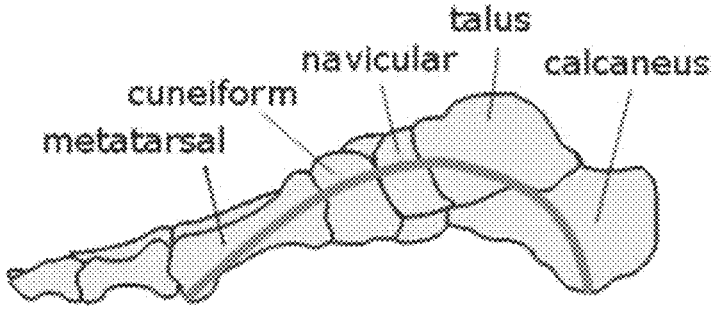
FIG. 12 shows the bones that make up the medial arch of the foot.

"Straddling" as used herein means, as above, placing the ball of the first toe and second toe of the foot 3 on the rectangle or upper half 9 of the block 2 with the lesser toes "hanging off" above the lower half 10 as shown, making the inner edge 14 of said rectangle and uppertrapezoid-surface line up with the longitudinal axis of the foot (FIG. 10, 20, 21). Following along the longitudinal axis of the foot 3 (FIG. 10), the apparatus forces the use of the medial arch of the foot 3 (FIG. 5, 12) while reducing the use of the lateral and metatarsal arches of the foot 3 (FIG. 11). The medial arch exists of the first metatarsal, medial cuneiform, navicular, talus and calcaneus bones (FIG. 12). Using the medial arch of the foot 3 facilitates, among others, the tibias posterior, peroneus longus, flexor hallucis longus, abductor hallucis, extensor hallucis longus and tibias anterior muscles. The aforementioned bones and muscles of the leg complex 1 are all involved in reducing compensatory movements, (i.e. rotation leg and adduction/abduction and inversion/eversion foot/ankle) during heel raise exercises. Using the apparatus results in more natural or functional movements of the leg and foot/ankle complex 1 (FIG. 6) because the bones and muscles involved in causing dysfunctional movements are inhibited. Thus, plantar flexion 4 and dorsiflexion 5 being "substantially devoid" of pronation and supination means a dysfunctional level of pronation and supination is nearly eliminated to the point of only natural or functional movement of the leg complex 1.

Of note, shoes can be worn but is not advisable. Shoes prevent a comfortable, exclusive use of the medial arch of the foot 3. The sole of the shoe acts like a rigid platform moving the foot 3 as a single, fixed unit. Using the medial arch of the foot 3, while avoiding the use of the lateral and metatarsal arch is problematic when wearing shoes. This makes a "true" plantar flexion 4 less unattainable. Even with the use of the suggested apparatus. Although using the apparatus without shoes is advised, wearing shoes does not warrant it useless. Compensatory movements are still reduced but to a lesser extent. If wearing shoes, increasing the rise over 12 mm may help reduce the compensatory movements slightly further. However, as previously mentioned a rise over 12 mm tends to inflict a more than necessary stress on the joints of the foot/ankle complex. A reduction of compensatory movements without inflicting (an unnecessary) stress on the joints of the lower leg is suggested. Again, shoe-less, a 12 mm rise suffices.

Figure 13:
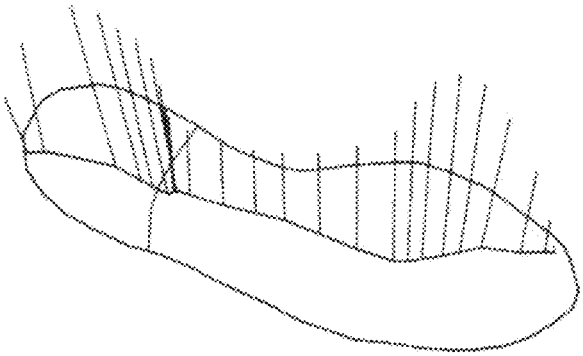
FIG. 13 shows center of pressure of ground reaction force in a subject user walking. This also runs along the longitudinal axis of the foot.
Figure 14:
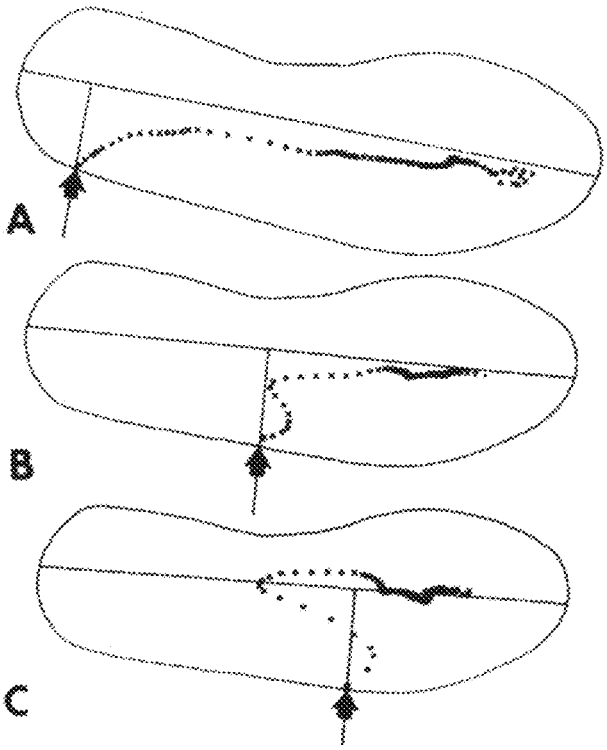
FIG. 14 shows the center of pressure of ground reaction force for three different types of runners—A heel, B midfoot, C forefoot runners. Despite the different running mechanics, the force exerted runs mostly along the longitudinal axis of the foot.
Figure 15:
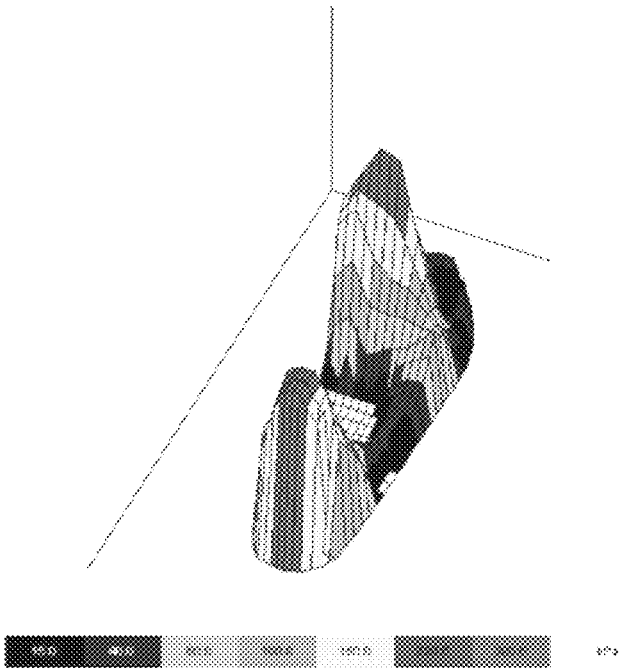
FIG. 15 is a graphical representation showing peak forces during gait. The highest peaks lay along and on the inside of the longitudinal axis of the foot, over the medial arch of the foot.
Figure 16:
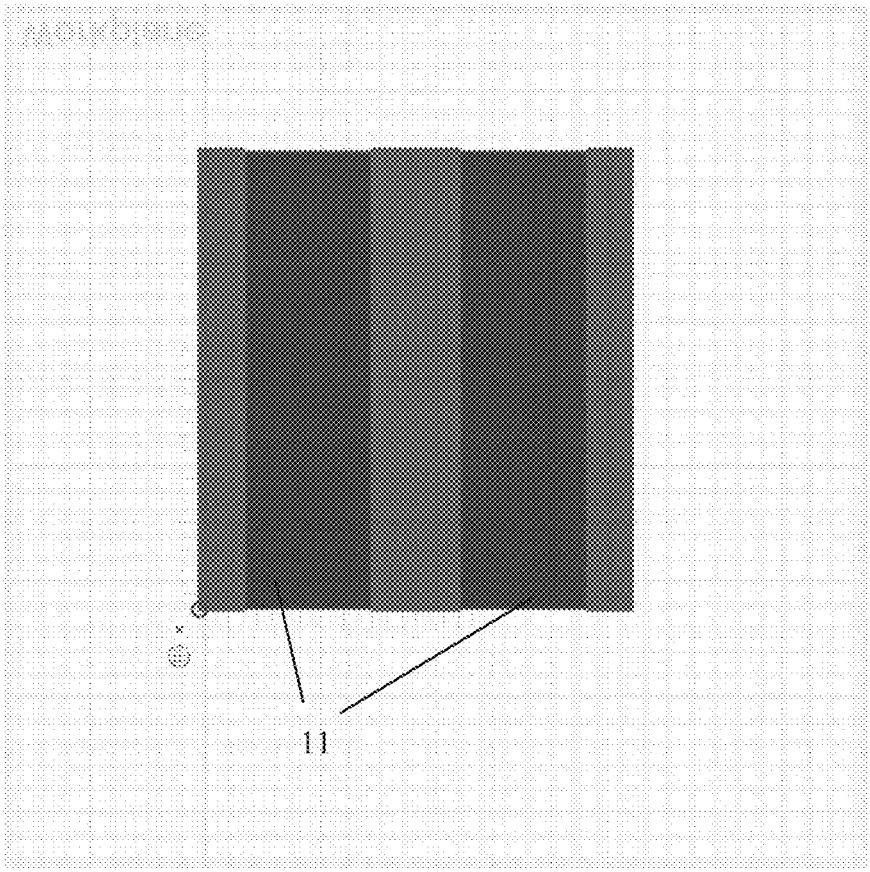
FIG. 16 shows a bottom view in elevation of the channels for elastic bands at the bottom of the isosceles trapezoid blocks.
Figure 17:
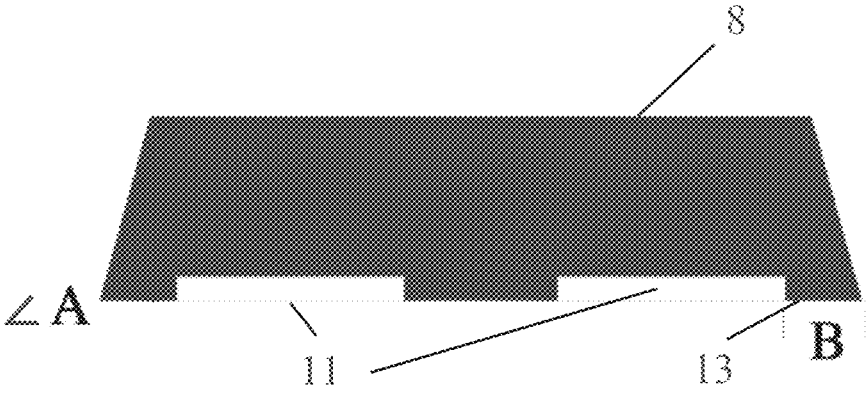
FIG. 17 shows a side view in elevation of the block including the channels for elastic bands at the bottom thereof.

During gait, humans are supposed to, but typically do not, use their foot along its longitudinal axis and exert pressure over the foot's medial arch mostly. It occurs naturally during walking and is amplified during running (FIG. 13, 14, 15). Replicating this natural pattern with calf raise exercises is only possible through the use of the instant method and apparatus and is advantageous. When it comes to health and well-being, (more) functional exercises are superior to their non-functional counterparts.

When doing a heel raise, the movement does not amount to plantar flexion 4 and dorsiflexion 5 exclusively. Because of how the human body is designed, combination movements occur. The downward motion of a heel raise results in dorsiflexion 5 of the ankle, an inward rotation of the leg and abduction and eversion of the foot/ankle complex 1. The upward motion consists of a plantar flexion 4 of the ankle, outward rotation of the leg and adduction and inversion of the foot/ankle complex 1. The described combination movements occur, among other reasons, because of the wedge shape of the talus bone (FIG. 29), the oblique malleolar and ankle joint axes and the location of the longitudinal axis of the foot (FIG. 10). The attachment points and path of leg and foot muscles in reference to said axes also play a part in the occurrence of a combination movements. As mentioned in the "description of the related art", combination movements are natural and, to a certain degree, necessary. However, they are not supposed to be too pronounced. The combination movement must stay within reason to prevent posture problems, dysfunction and injury. The multi-axial nature of a heel raise using the instant apparatus and methodology provokes a co-contraction of most foot and leg muscles and muscles not typically involved in a normal heel raise are activated, thereby improving joint stability and strength.

Figure 1:
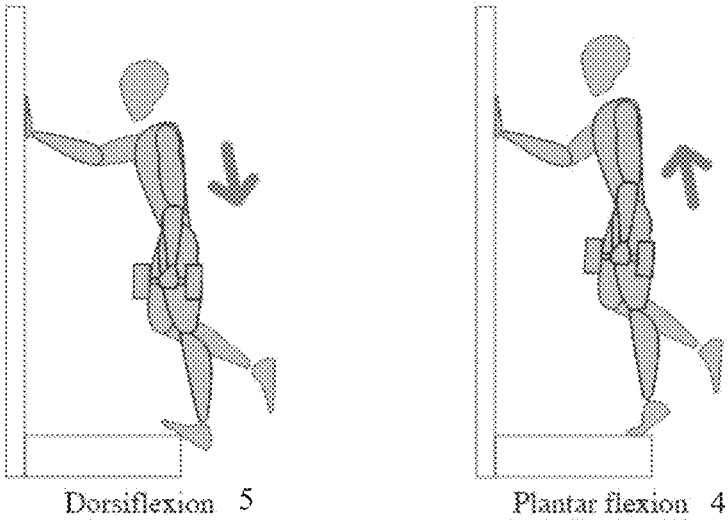
FIG. 1 is an illustration showing the two main phases of a resisted (dumbbell), single leg, straight knee heel or calf raise exercise.
Figure 2:
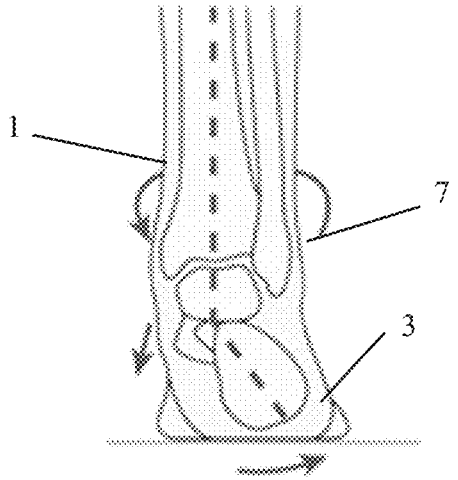
FIG. 2 is an illustration showing a pronation (inward rotation leg, dorsiflexion ankle and abduction, eversion foot/ankle) position of the foot/ankle complex.
Figure 3:
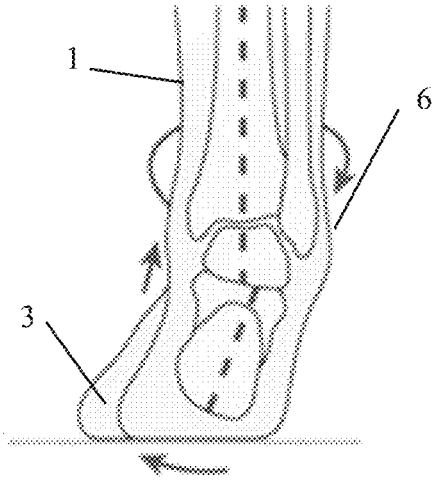
FIG. 3 shows a supination (outward rotation leg, plantar flexion ankle and adduction, inversion foot/ankle) position of the foot/ankle complex.
Figure 4:
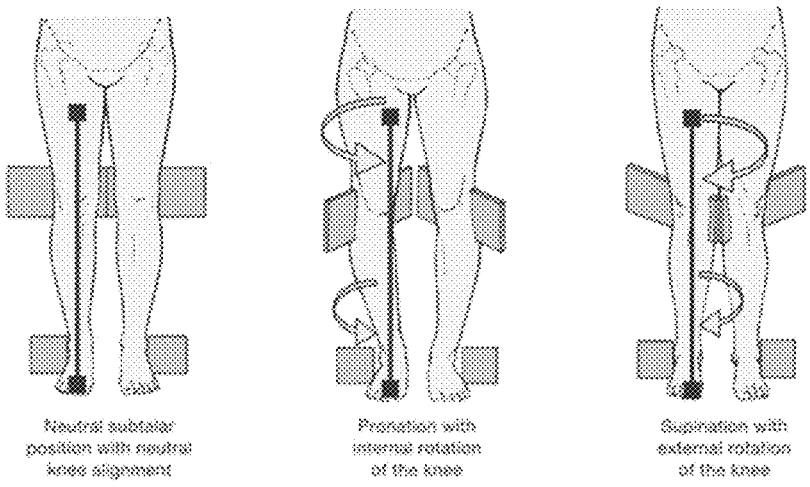
FIG. 4 is a representation of the lower half of a user showing the consequences of a supination and pronation position of the foot/ankle complex.
Figure 5:
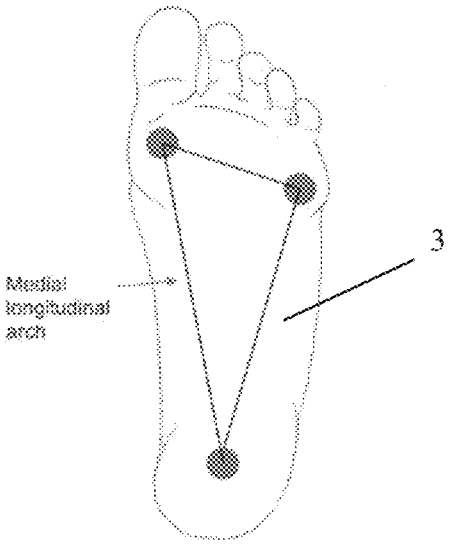
FIG. 5 is an illustration showing the medial longitudinal arch of the foot.
Figure 6:
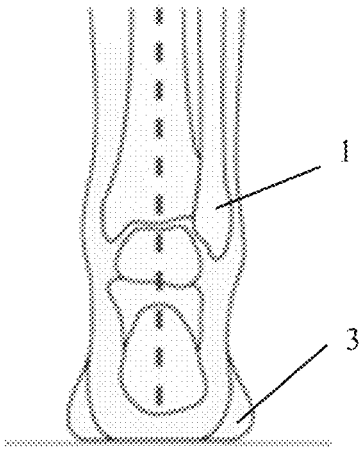
FIG. 6 shows a neutral (stacked) position of the foot/ankle complex.

By doing heel raise exercises with less compensatory movements, by activating (using) the medial arch of the foot and the muscles related to said medial arch, the alignment of the foot improves. Leg rotation lessens and adduction/abduction and inversion/eversion of the foot/ankle complex is reduced leading to a more neutral foot position (FIG. 6). This occurs initially only when using (activating/exercising) the medial arch but, if done often enough, eventually occurs when sedentary also. Foot alignment improves permanently. By improving the position of the foot/ankle and leg, the apparatus helps keep the back, hip, knee and ankle joints stacked (lined up longitudinally) in a more natural position. It helps improve overall posture from the ground up. While doing the heel raise exercise, the joints stay stacked mostly, reducing compensatory movements. Overall, this favorable situation (a more neutral/natural alignment of the foot, stacking of the joints of the lower extremity and better overall posture) improves joint stability and general function, which in turn helps prevent injury and speeds up recovery when hurt. Dysfunctional movement patterns, moving in an unhealthy or injury/pain-causing manner, are for obvious reasons not desirable. Oddly enough, preventing and solving said dysfunctional movement patterns is done by moving and exercising the "right" way. By repeatedly going through (training) a functional or healthy movement (pattern).

The proposed apparatus helps reduce compensatory movement during calf raise exercises. It helps users do the exercise "right". Executing a calf raise exercise properly, mimicking the use of the leg and foot/ankle complex 1 during a healthy gait and running, results in better alignment of the foot (reduces/limits pronation and supination position of the foot—FIGS. 2 and 3). Improved alignment of the foot, in turn, results in a healthier gait, better overall posture and prevents and treats a long list of potential pain and injuries to the lower extremity and back (FIG. 6), e.g. turf toe, ankle sprain, ACL injuries, hip labrum injuries and back problems. The proposed apparatus makes the proper execution of a resisted, single leg, straight or bent knee calf raise exercise attainable for everyone, regardless of age, fitness and athleticism. In addition, it is portable (light-weight), easy to use and very affordable.

I claim:

1. A method for reducing compensatory leg complex movements, comprising the steps of:

providing multiple blocks, wherein each of said multiple blocks varies in size, and wherein at least one block of said multiple blocks includes a top divided in two-halves thereby forming an upper half and a lower half at said top;

wherein said upper half of said at least one block and said lower half of said at least one block differ in height so as to allow a user to engage said at least one block with a foot of said user straddling said upper half and said lower half;

wherein upon a heel raise of said user upon said at least one block, plantar and dorsiflexion movement is achieved substantially devoid of pronation and supination; and, wherein for the step of straddling, first and second toes of said user engage said upper half of said at least one block and third, fourth and fifth toes of said user hang over said lower half of said at least one block, thereby an edge of said upper half is disposed along a longitudinal axis of said foot such that said heel raise is multi-axial.

2. The method of claim 1, wherein said size of each of said multiple blocks is selected from a group consisting of twelve (12) millimeters, twenty-two (22) millimeters, thirty-two (32) millimeters and forty-two (42) millimeters.

3. The method of claim 1, wherein said lower half of said at least one block is twelve (12) millimeters lower than said upper half.

4. The method of claim 1, wherein each of said multiple blocks consists of high density, closed cell foam.

5. The method of claim 1, wherein said user engages each said block in progression from shortest to tallest, thereby increasing dorsiflexion of said user.

6. The method of claim 1, further comprising the step of providing elastic bands to add resistance to said heel raise.

7. An apparatus for reducing compensatory leg complex movements, comprising:

multiple blocks, wherein each of said multiple blocks varies in size, and wherein at least one block of said multiple blocks includes a top divided in two-halves thereby forming an upper half and a lower half at said top;

wherein said upper half of said at least one block and said lower half of said at least one block differ in height so as to allow a user to engage said at least one block with a foot of said user straddling said upper half and said lower half;

wherein upon a heel raise of said user upon said at least one block, plantar and dorsiflexion movement is achieved substantially devoid of pronation and supination; and, wherein said size of each of said multiple blocks is selected from a group consisting of twelve millimeters, twenty-two millimeters, thirty-two millimeters and forty-two millimeters.

8. The apparatus of claim 7, wherein said lower half of said at least one block is twelve millimeters lower than said upper half.

9. The apparatus of claim 7, wherein each of said multiple blocks consists of high density, closed cell foam.

10. The apparatus of claim 7, wherein each of said multiple blocks is engaged by the user in progression from shortest to tallest.

11. The apparatus of claim 7, wherein said upper half of said at least one block is adapted to receive first and second toes of a user, and wherein third, fourth, and fifth toes of said user hang over said second half of said at least one block.

12. The apparatus of claim 7, further comprising elastic bands to add resistance to said heel raise.

13. The apparatus of claim 7, further comprising a pair of channels defined on a bottom of each of said multiple blocks.

14. An apparatus for reducing compensatory leg complex movements, comprising:

multiple blocks, wherein each of said multiple blocks varies in size, and wherein at least one block of said multiple blocks includes a top divided in two-halves thereby forming an upper half and a lower half at said top;

wherein said upper half of at least one said block and said lower half of at least one said block differ in height so as to allow a user to engage said at least one block with a foot of said user straddling said upper half of at least one said block and said lower half of at least one said block;

wherein upon a heel raise of said user upon said at least one block, plantar and dorsiflexion movement is achieved substantially devoid of pronation and supination; and, wherein said lower half of said at least one block is twelve millimeters lower than said upper half.

* * * * *